US008298739B2

(12) United States Patent
Anno et al.

(10) Patent No.: US 8,298,739 B2
(45) Date of Patent: Oct. 30, 2012

(54) ELECTROPHOTOGRAPHIC TONER

(75) Inventors: Masahiro Anno, Tokyo (JP); Kazuyoshi Goan, Kanagawa (JP); Makoto Nomiya, Tokyo (JP); Kouji Sugama, Tokyo (JP); Masahiro Matsuoka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 240 days.

(21) Appl. No.: 12/787,454

(22) Filed: May 26, 2010

(65) Prior Publication Data

US 2010/0304288 A1 Dec. 2, 2010

(30) Foreign Application Priority Data

Jun. 2, 2009 (JP) ..... 2009-132878

(51) Int. Cl.
*G03G 9/107* (2006.01)

(52) U.S. Cl. ..... 430/108.6; 430/110.3

(58) Field of Classification Search ..... 430/108.6, 430/110.3
See application file for complete search history.

(56) References Cited

U.S. PATENT DOCUMENTS

| | | | | |
|---|---|---|---|---|
| 6,100,000 | A * | 8/2000 | Anno et al. | 430/110.4 |
| 2007/0275316 | A1 * | 11/2007 | Ishikawa et al. | 430/108.3 |
| 2009/0142684 | A1 * | 6/2009 | Anno et al. | 430/108.6 |

FOREIGN PATENT DOCUMENTS

| | | |
|---|---|---|
| JP | 8334918 | 12/1996 |
| JP | 2001290302 | 10/2001 |

* cited by examiner

*Primary Examiner* — Peter Vajda
(74) *Attorney, Agent, or Firm* — Lucas & Mercanti, LLP

(57) ABSTRACT

A toner comprising toner particles, wherein a surface-treated titanate compound is contained on the surface of parent toner particles comprising a resin and a colorant, and the titanate compound having a carbon amount of not less than 0.15% by mass and not more than 0.50% by mass.

8 Claims, 1 Drawing Sheet

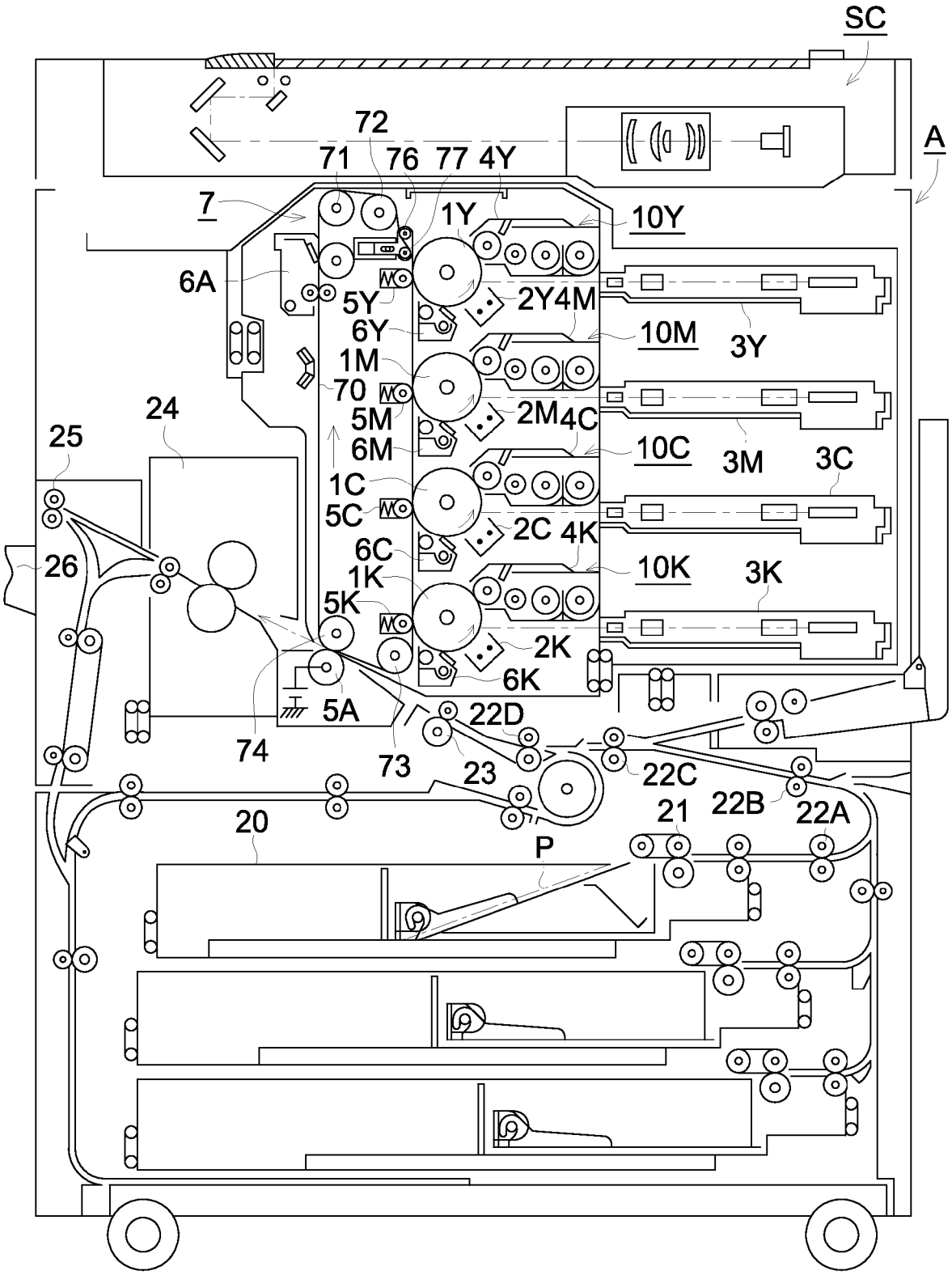
SC
A
72
71
76
77
4Y
7
1Y
10Y
6A
5Y
2Y
4M
6Y
10M
3Y
1M
70
5M
2M
4C
6M
10C
3M
3C
25
24
1C
5C
2C
4K
26
6C
10K
3K
1K
5K
2K
6K
5A
22D
74
73
23
22C
22B
22A
21
20
P

ELECTROPHOTOGRAPHIC TONER

This application claims priority from Japanese Patent Application No. 2009-132878, filed on Jun. 2, 2009, which is incorporated hereinto by reference.

FIELD OF THE INVENTION

The present invention relates to a toner for use in electrophotographic image formation and in particular to a toner in which a titanium compound is incorporated, as an external additive, to the toner particle surface.

TECHNICAL FIELD

A toner used for image formation of electrophotographic systems, to which inorganic or organic particles, usually called an external additive is added to achieve excellent image formation, is designed so that toner performance such as electrification property or flowability is maintained by the external additive.

Compounds used as an external additive include a titanate compound, typified by calcium titanate or strontium titanate. It was known that such a titanate compound added as an external additive to a toner contributed to prevention of filming on the photoreceptor surface and cleaning capability thereof.

A titanate compound, which exhibits enhanced dielectric properties, has been expected to contribute to enhancement of electrification property of a toner and there was an attempt of external-addition of a titanate compound to a toner to achieve enhanced electrification property of the toner. For instance, there was disclosed a technique in which metal titanate particles were added to a magnetic toner to reduce aggregation of toner particles by employing the dielectric property of the metal titanate particles, leading to reduction in toner consumption (as set forth in, for example, Japanese Patent Application JP 8-334918A). There was also disclosed a technique in which a titanate compound was externally added to a toner controlled in form and size to achieve enhanced electrification performance and stabilized electrification property (as set forth in, for example, JP 2001-290302A).

There was also noted an abrasive action of a titanate compound and it was known that addition of a titanate compound, as an external additive to a toner was preferable in terms of the photoreceptor surface being sufficiently abraded to maintain image forming performance. However, excessive abradability often resulted in coarse abrasion of the photoreceptor surface, producing flaws and resulting in streak-like noises or density unevenness on a solid image or a halftone image, which was not preferable in achieving excellent image quality. Specifically, there increased cases of forming images of high-contrast and high-precision, such as a photographic image composed of fine dot images along with recent development of digitization, so as to avoid image troubles due to damages to the photoreceptor, caused by abrasion.

Further, a titanate compound exhibits the property of being easily aggregated and leading to concern such that a titanate compound released from toner particles aggregates and an aggregate thereof produced image defects on a print or its accumulation on the photoreceptor surface caused filming.

With such background, there was studied a toner in which a titanate compound hydrophobilized with silicone oil was added as an external additive. Such hydrophobilizing treatment with a silicone oil was expected to reduce an abrasion action of the titanate compound and also to inhibit aggregation of released materials, leading to elimination of the foregoing problems. However, a toner using such a hydrophobilized titanate compound as an external additive exhibited tendency of an electric charge being difficult to be leaked, resulting in an increased electrostatic charge, which affected raising the performance of electrification. This was assumed to be due to the hydrophobilizing treatment resulting in a lowering of surface moisture content of the titanate compound, rendering an electrical charge difficult to be leaked. Specifically when forming images under low temperature and low humidity of a reduced moisture content in ambientair, such a tendency was observed.

Thus, there was a toner using a titanate compound as an external additive in which electrification performance and cleaning capability have come into effect in a balanced manner without causing aggregation of a released titanate compound.

SUMMARY OF THE INVENTION

It is an object of the present invention to provide a toner in which a titanate compound is used as an external additive, and electrification performance and cleaning capability have come into effect in a balanced manner without causing any image defects due to aggregation of the titanate compound. Specifically, it is an object to a toner capable of stably maintaining excellent electrification performance without performing severe cleaning which adversely affects image quality, such as roughly abrading the photoreceptor surface or producing flaws. It is also an object of the invention to provide a toner which does not generate image defects or filming due to aggregation of the titanate compound released from the toner.

As a result of extensive study, it was found that the foregoing problems were overcome by any of the following constitutions.

One aspect of the present invention is directed to a toner comprising toner particles, wherein a titanate compound having been subjected to a surface treatment is contained on the surface of parent toner particles comprising a resin and a colorant, and the titanate compound having a carbon amount of not less than 0.15% by mass and not more than 0.50% by mass.

In one preferred aspect of the invention, the titanate compound is one having been subjected to the surface treatment by using a silicone oil.

In one preferred aspect of the invention, the silicone oil includes dimethyl polysiloxane.

In one preferred aspect of the invention, the titanate compound contains iron in an amount of 100 ppm to 1000 ppm.

In one preferred aspect of the invention, the titanate compound is calcium titanate or magnesium titanate.

In one preferred aspect of the invention, the titanate compound exhibits a BET specific surface area of not less than 5 $m^2/g$ and not more than 25 $m^2/g$.

In one preferred aspect of the invention, the titanate compound exhibits a number-based average particle size of not less than 50 nm and not more than 2000 nm and a standard deviation of particle size of not more than 250 nm.

Another aspect of the invention is directed to a surface treatment method of a titanate compound to be incorporated to a toner for use in image formation of an electrophotographic system, comprising subjecting parent toner particles to a surface treatment by using a titanate compound, wherein the surface treatment is controlled so that the carbon amount of the titanate compound is not less than 0.15% by mass and not more than 0.50% by mass.

It was found by the inventors of this application that a toner, which achieved electrification performance and cleaning capability in a balanced manner without causing any image defect due to aggregation of the titanate compound, was obtained by use of a titanate compound having a carbon amount of not less than 0.15% by mass and not more than 0.50% by mass. Thus, the use of a toner containing a titanate compound having a carbon amount falling within the foregoing range made it feasible to clean the photoreceptor surface without generating rough abrasion or flaws, leading to a solid image or a half-tone image having no streak-like noise or density unevenness. Further, the invention enabled to avoid occurrence of image defects due to aggregation of the titanate compound or occurrence of filming caused by accumulation of aggregates on the photoreceptor surface.

In the invention, it was further found that in a toner which was externally incorporated with a titanate compound having been hydrophobilized with a silicone oil or the like, excellent rising-performance of electrification with optimal leakage of an electrostatic charge was also achieved by controlling the carbon amount of the titanate compound so as to fall within the foregoing range. In the invention, it was found that problems such as a lowering of leakage performance which occurred in a toner using a titanate compound hydrophobilized in the prior art were overcome by subjecting a titanate compound to a hydrophobilizing treatment so that the carbon amount of the titanate compound fell within a prescribed range.

Accordingly, when conducting print preparation by using a toner which externally incorporated a hydrophobilized titanate compound under an environment of low temperature and low humidity, prints of prescribed image quality were stably prepared due to excellent leakage performance in the invention. Thus, it was found in the invention that the hydrophobilizing treatment of a titanate compound could be controlled by restricting the carbon amount of the hydrophobilized titanate compound, and thereby enabling to prepare a toner in which electrification performance and cleaning performance were compatibly achieved. It was also found that leakage performance of the surface-treated titanate compound was attained by controlling the carbon amount.

BRIEF DESCRIPTION OF THE DRAWING

FIG. 1 illustrates an example of an image forming apparatus corresponding to a two-component developer.

DETAILED DESCRIPTION OF THE INVENTION

The present invention relates to a toner for use in image electrophotographic image formation and a toner using a titanate compound as an external additive.

The toner related to the invention comprises toner particles, in which a titanate compound having been subjected to a surface treatment is contained on or over the surface of the parent toner particles comprising a resin and a colorant. It was found that the thus contained titanate compound has a carbon amount of not less than 0.15% by mass and not more than 0.50% by mass, whereby the photoreceptor surface was cleaned without generating rough abrasion or flaws, leading to stable formation of a solid image or a half-tone image having no streak-like noise or density unevenness. It was further found that even when the added titanate compound was released from the toner particle surface, the thus released titanate compound did not easily aggregate, rendering it feasible to avoid occurrence of image defects due to aggregation or occurrence of filming due to accumulation of aggregates on the photoreceptor surface.

In the invention, it was proved that controlling the carbon amount of a titanate compound so as to fall within the foregoing range overcame leakage trouble of electric charge occurring in a conventional toner in which a surface-treated titanate compound was externally added. Based on this finding, it was confirmed that in a toner which was externally added with a surface-treated titanate compound, enhanced charge-rising performance was achieved.

In the invention, specifying the carbon amount of a titanate compound, as described above, enabled control of the surface treatment of a titanate. As a result, there was no chance of a titanate compound of high hardness being in direct contact with the photoreceptor surface, enabling stable cleaning without generating abrasion or flaws. Further, an excessive surface treatment was avoided and excellent electric-charge leakage performance which was inherent to a titanate compound has come into effect.

Although there was known a toner externally added with a titanate compound which was surface-treated by immersion in a silicone oil or the like, it was difficult to perform a surface treatment of a titanate compound so as to achieve cleaning performance and electric-charging performance in a balanced manner. The reason why the surface treatment of a titanate compound resulted in enhanced cleaning performance and reduced aggregation was presumed by the inventors of this application, as follows. It was assumed that the surface treatment formed an elastic organic layer on the surface of a titanate compound and abrasiveness of the titanate compound was reduced by the existence of this organic layer, rendering it feasible to perform cleaning of the photoreceptor surface without causing abrasion or flaws. Further, it was assumed that an elastic action achieved by the organic layer reduced aggregation of the titanate compound, leading to prevention of image defects or filming on the photoreceptor surface which was due to aggregates.

The reason that the use of a surface-treated titanate compound lowers charge leakage performance was presumed to be as follows. It was presumed that an organic layer formed on the surface of the surface-treated titanate compound became excessively thick and adversely affected electrical conductivity of the titanate compound, leading to a lowering of charge leakage performance. On the contrary, it was also presumed that when the surface treatment was insufficient, an organic layer of a thickness enough to reduce abrasiveness of the titanate compound was not formed on the surface of the titanate compound, which achieved sufficient leakage performance but rendered it difficult to avoid abrasion or flaws. Based on the foregoing presumption, the inventors of this application extensively studied how to form, on the titanate compound surface, an organic layer of a thickness enough to perform cleaning without causing damage to the photoreceptor surface, while achieving sufficient charge leakage performance, and a method of performing a surface treatment for the titanate compound, while knowing the thickness of the organic layer. As a result, the present invention has come into being.

It was found by the inventors that excellent cleaning performance and electrification performance were achieved in a balanced manner by use of a toner which was externally added with a surface-treated titanate compound so that its carbon amount was not less than 0.15% by mass and not more than 0.50% by mass. Thus, it was found that prescription of the carbon amount of a titanate compound enabled to control the surface treatment for the titanate compound. It also rendered it feasible to obtain a titanate compound which was capable of performing cleaning with appropriately controlled abrasive performance without causing abrasion or flaws on the photoreceptor surface and achieving excellent electric-charge leakage performance which was inherent to a titanate compound. In the invention, it was found that a toner, in which cleaning performance and electrification performance were compatibly achieved, was obtained by subjecting a titanate compound to a surface treatment so that the carbon amount fell within a prescribed range.

There will be further described the invention in detail.

First, there will be described a titanate compound used in a toner related to the invention. A titanate compound used in a toner related to the invention is one which has been subjected to a surface treatment and exhibits a carbon amount of not less than 0.15% and not more than 0.50% by mass. When the carbon amount of a titanate compound falls within the above range, there can be obtained a toner which achieves superior cleaning performance without causing abrasion or flaws on the photoreceptor surface and also attains enhanced electrification performance through charge leakage performance of the titanate compound.

A toner which uses a titanate compound in a carbon amount falling outside the above range does not achieve the advantageous effects of the invention. Specifically, a toner having been added with a titanate compound in a carbon amount less than 0.15% by mass is insufficient in a surface treatment of the titanate compound and renders it difficult to perform sufficient cleaning on the photoreceptor surface. Accordingly, when cleaning the photoreceptor surface, abrasion or flaws easily occur, making it difficult to form a solid image or a halftone image of high image quality. Further, the titanate compound easily aggregates, causing image defects due to aggregation or filming of aggregates onto the photoreceptor surface, making it difficult to prepare a print of prescribed image quality.

In a toner having been added with a titanate compound in a carbon amount more than 0.50% by mass, an excessive surface treatment results in a lowering of the surface moisture content of the titanate compound, rendering it difficult to achieve its electric charge leakage performance, and also adversely affecting electrification-rising performance. Accordingly, for instance, when performing preparation of prints in an atmosphere of a low moisture content under low temperature and low humidity, it becomes difficult to stably prepare prints of prescribed image quality.

In the invention, "carbon amount" means carbon content, that is, the content of carbon per unit mass of a titanate compound. In the invention, "carbon amount of a titanate compound" can be determined by using a conventional carbon analytical instrument, for example, a commercially available carbon analytical instrument, IR-212 (made by LECO Co., Ltd.). Specifically, a ceramic crucible is placed on the weighing portion of the above-described instrument and 1 g of a measured sample is weighed out into the crucible. After weighing out the measured sample, a combustion improver is added thereto in an amount of one spatula. The crucible containing the measured sample and the combustion improver was placed on a ceramic plate of the instrument and was subjected to a combustion treatment using oxygen as a combustion gas to measure he carbon amount.

There will be described a surface treatment which was conducted for a titanate compound used in the invention. The titanate compound used in the invention is one which was subjected to a surface treatment in advance by using a surface treatment agent, as typified by a silicone oil. Subjecting the titanate compound to a surface treatment enables obtaining a titanate compound having a carbon amount falling within the foregoing prescribed range.

The procedure of the surface treatment for a titanate compound is, for example, as follows:

(1) A titanate compound which was produced by a commonly known production method is placed into water and stirred to prepare an aqueous dispersion of the titanate compound;

(2) a surface treatment agent is fed to the aqueous titanate compound dispersion and further stirred;

(3) after completion of stirring, the titanate compound dispersion was filtered off and washed to separate the titanate compound;

(4) the separated titanate compound was dried; and (5) the dried titanate compound was disintegrated to obtain a surface-treated titanate compound.

In accordance with the foregoing procedure, for example, there can be obtained a titanate compound having a carbon amount of not less than 0.15% by mass and not more than 0.50% by mass.

There will be further described a surface treatment of a titanate compound.

A surface treatment agent used in the surface treatment for a titanate compound used in the invention is one which enables making the carbon amount of the titanate compound to be not less than 0.15% by mass and not more than 0.50% by mass, and specific examples thereof include a silicone oil, typified by dimethyl polysiloxane.

The carbon amount of a titanate compound after being subjected to a surface treatment is derived from a surface treatment agent used in the surface treatment, and it is supposed that as the surface treatment agent adheres in a larger amount to the titanate compound surface, the carbon amount increases. Accordingly, when subjecting a titanate compound to a surface treatment by using a surface treatment agent, the carbon amount of the titanate compound can be controlled by treatment time, the kind or amount of a surface treatment agent, and the like.

Examples of a surface treatment agent include silicone oils. Such silicone oils include a straight silicone oil constituted of a polysiloxane of a straight chain polymer formed of a siloxane bond and a modified silicone oil in which an organic group is introduced to a side chain or an end group of polysiloxane.

Straight silicone oils include dimethyl silicone oil (also called dimethyl polysiloxane or polydimethylsiloxane) in which all of side chains and end groups of polysiloxane are a methyl group, and a methyl hydrogen silicone oil in which a part of the side chains is a hydrogen atom. The structures of dimethyl silicone oil, methylphenyl, methyl phenyl silicone oil and methyl hydrogen silicone oil are shown below:

(1) Dimethyl silicone oil (dimethyl polysiloxane)

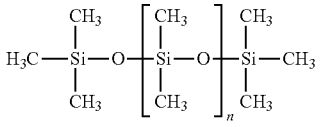

-continued (2) Methyl hydrogen silicone oil

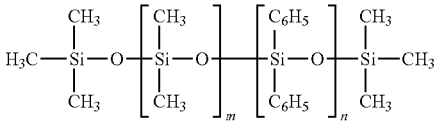

(3) Methyl hydrogen silicone oil

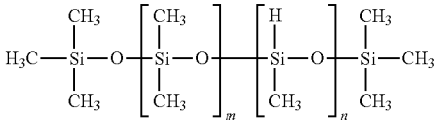

Modified silicone oils are classified in four classes in accordance with the bonding position of an introduced organic group, and include (1) a side chain type in which the organic group is introduced to a part of the side chain, (2) a both-end type in which the organic group is introduced to both ends of a polysiloxane, (3) a single-end type in which the organic group is introduced to either one of both ends of a polysiloxane and (4) a side chain and both end type in which the organic group is introduced to a part of the side chain and both ends. There are shown below the structures of (1) side chain type, (2) both end type, (3) one-end type and (4) side chain and both end type of dimethyl polysiloxane.

(1) Side chain type

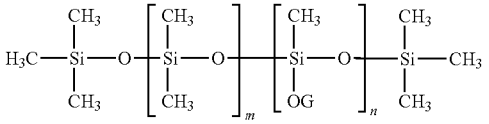

(2) Both end type

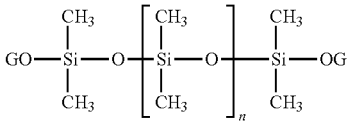

(3) One-end type

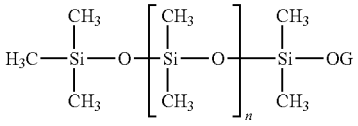

(4) Side chain and both end type

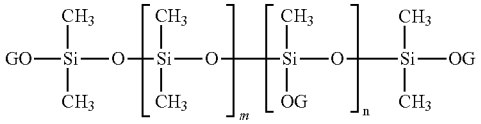

OG: Organic Group

Further, modified silicone oils are also classified to a reactive silicone oil and a non-reactive silicone oil in accordance with the properties of an organic group to be introduced.

Among these silicone oils, a straight silicone oil is preferred, in which the kind of constituent atoms tends to be less, compared to a modified silicone oil. A straight silicone oil which contains no reactive site is not required to take into account effects of reactivity, making it easy to calculate the carbon amount for the addition amount. A straight silicone oil which has a stable structure against temperature or light is also to be superior in storage stability.

Of such straight silicone oils, in the invention, dimethyl polysiloxane (or dimethyl silicone oil) is preferred. Dimethyl siloxane has a structure in which methyl groups are introduced to all of a side chain and both ends, and is unified in constitution derived from carbon atoms of a silicone oil molecule and determining the carbon amount. Accordingly, it is advantageous in calculation of the carbon amount, and, for example, the addition amount of a surface-modifying agent necessary to obtain the desired carbon amount being unequivocally set. It also belongs to a general-purpose class among silicone oils and is commercially available stably at a low price, compared to other silicone oils.

A titanate compound is surface-treated mainly in such a manner that the titanate compound is dispersed in an aqueous medium and a surface treatment agent is added to the aqueous titanate dispersion. In that case, the surface treatment agent is required to be homogeneously dispersed in the aqueous medium and preferably is in the form of for example, an emulsion of dimethyl polysiloxane.

Such an emulsion of dimethyl polysiloxane is not specifically limited and commercially available ones are usable. The average molecular weight of dimethyl polysiloxane constituting a commercially available silicone emulsion is, in general, approximately 10,000, and the average polymerization degree calculated from the structural formula is approximately 134. The carbon amount of the emulsion is from 15% to 40% by mass and a carbon amount of 20% by mass is preferable. The carbon amount of a titanate compound dispersion after being added to a silicone emulsion is not specifically limited but preferably not less than 0.2% by mass and not more than 2.0% by mass, and is more preferably not less than 0.5% by mass and not more than 1.5% by mass.

It is assumed that the surface treatment of a titanate compound with a silicone oil forms a layer having a carbon content of not less than 0.15% and not more than 0.5% by mass and carbon atoms contained in this layer control the carbon amount of the titanate compound. It is also assumed that a number of polar groups such as a hydroxyl group exista on the titanate compound surface and a coupling reaction between the polar groups and dimethylsiloxane takes place, resulting in formation of this layer. It is further assumed that such polar groups, existing on the titanate compound surface, are consumed in the coupling reaction and hydrophobilization of the titanate compound is promoted along with the surface treatment.

There is applicable not only a method employing the foregoing reaction but also a method in which an emulsion of dimethyl polysiloxane is physically surface-treated onto the surface of a titanate compound.

In the invention, based on the foregoing reasoning, an emulsion of dimethylsiloxane is added to a titanate compound dispersion and stirred, whereby a titanate compound having a carbon amount of not less than 0.15% and not more than 0.50% by mass is obtained. Specific embodiments of performing a surface treatment of a titanate compound by using a dimethylsiloxane emulsion will be later detailed in Examples.

In the following, there will be described a titanate compound usable in the invention and its production method. A titanate compound usable in the invention is typically a so-called metatitanate salt formed of titanium (IV) oxide and other metal oxides or metal carbonates and represented by the following formula (1):

$$M^{I}_{2}TiO_{3} \text{ or } M^{II}TiO_{3} \qquad \text{Formula (I)}$$

where $M^I$ represents a univalent metal and $M^{II}$ represents a bivalent metal. A titanate compound usable invention is preferably one which is represented by $M^{II}TiO_3$ having a structure of being bonded to a bivalent metal atom. Specific examples of such a titanate compound of being bonded to a bivalent metal include calcium titanate ($CaTiO_3$), magnesium titanate ($MgTiO_3$), strontium titanate ($SrTiO_3$) and barium titanate ($BaTiO_3$). Of these titanate compound bonded to a bivalent metal, calcium titanate ($CaTiO_3$) and magnesium titanate ($MgTiO_3$) are preferred in terms of an environmental influence and keeping the electrostatic charge amount at a constant level over a long duration.

Titanate compounds usable in the invention can be prepared by any methods known in the art. Such methods include a method of preparing a titanate compound via a hydrated titanium (IV) oxide $TiO_2.H_2O$, also known as metatitanic acid. In this method, the foregoing titanium (IV) oxide is reacted with a metal carbonate such as calcium carbonate or a metal oxide, followed by a calcination treatment to form a titanate compound, typified by calcium titanate.

A hydrolysate of a titanium oxide, such as metatitanic acid is also called a mineral acid-deflocculated material in the form of liquid in which a titanium oxide is dispersed. To such a mineral acid-deflocculated material composed of a titanium oxide hydrolysate is added a water-soluble metal carbonate or metal oxide and the mixture solution is reacted at 50° C. with addition of an aqueous alkaline solution to prepare a titanate compound.

Metatitanic acid, as one of typical mineral acid-deflocculated materials has a sulfinic acid ($SO_3$) content of not more than 1.0% by mass, preferably not more than 0.5% by mass, and obtained by deflcculation with adjusting the pH to from 0.8 to 1.5 with hydrochloric acid.

An aqueous alkaline solution used for preparation of a titanate compound preferably employs an aqueous caustic alkali solution, as typified by an aqueous sodium hydroxide solution. Examples of a compound to be reacted with a hydrolysate of a titanium oxide include nitrate, carbonate or chloride compounds of strontium, magnesium, calcium, barium, aluminum, zirconium, sodium or the like.

In the process of preparing a titanate compound, the particle size of a titanate compound can be controlled can be controlled by control of the addition ratio of a metal oxide or the like to a hydrate or hydrolysate of a titanium oxide, a concentration of titanium oxide or hydrolysate of titanium oxide at the time of reaction or temperature or addition rate at the time of addition of an aqueous alkaline solution. It is preferred to perform the reaction in a nitrogen gas atmosphere to inhibit formation of a carbonate compound in the reaction process.

The addition ratio of metal oxide or the like to titanium oxide hydrolysate, expressed in (metal oxide or the like)/$TiO_2$ is preferably from 0.9 to 1.4, and more preferably from 0.95 to 1.15. The concentration of a titanium oxide hydrolysate at the initial stage of reaction, represented by an equivalent converted to $TiO_2$ is preferably from 0.05 to 1.0 mol/l, and more preferably from 0.1 to 0.8 mol/l.

A higher temperature at the time when adding an aqueous alkaline solution results in a higher crystallinity but the temperature is optimally from 50 to 101° C. in practice. The addition rate of an aqueous alkaline solution tends to affect the particle size of the obtained titanate compound, a slower addition rate tends to form a titanate compound of larger particles, and a faster addition rate tends to form a titanate compound of smaller particles. The addition rate of an aqueous alkaline solution is preferably from 0.001 to 1.0 equivalent/hr, based on charge stock, and more preferably 0.005 to 0.5 equivalent/hr, which is controllable corresponding to the intended particle size. The addition rate of an aqueous alkaline solution can be controlled in accordance with the object.

The titanate compound used in the invention preferably contains iron in an amount of not less than 100 ppm and not more than 1000 ppm. Including iron in an amount of not less than 100 ppm and not more than 1000 ppm in a toner particle functions as an effective charged site, achieves excellent charge-rising performance and charge-holding performance and can also optimally leak an excessive charges. It is supposed that existence of iron in an amount within the foregoing range in a surface-treated titanate compound promotes leakage of excessive charges. Even in a titanate compound having formed a comparatively thick organic layer, therefore, leakage of excessive charge is promoted by such existence of iron, and thereby ensuring charge-rising property and charge retenston performance. Accordingly, it becomes feasible to perform easy cleaning without giving rise to abrasion or flaws on the photoreceptor surface over a long period of time and in addition achieve superior electrification performance.

When the iron content of a titanate compound is less than 100 ppm, promotion of leakage of excessive charges is not much expected, and therefore, it is preferred to perform the surface treatment of a titanate compound so that the carbon amount is in the vicinity of 0.15% by mass of the lower limit in the invention. Such control of the surface treatment ensures charge leakage performance of a titanate compound and avoids electrostatic charge being accumulated in a toner, leading to an increase of a saturated electrostatic charge. It is to be avoidable to cause abrasion or flaws on the photoreceptor surface at the time of cleaning. Specifically, even when performing printing under environments of low temperature and low humidity in which charge leakage becomes difficult due to atmospheric moisture, the saturated electrostatic charge of a toner is not excessively increased, so that there is no concern of problems such as flight of toner particles onto the photoreceptor surface.

An iron content of a titanate compound of more than 1000 ppm forms an environment easy to perform charge leakage and it is stipulated that charge leakage frequently occurs and affects charge accumulation onto a toner. Therefore, it is preferred to perform the surface treatment of a titanate compound so that the carbon amount is in the vicinity of 0.50% by mass of the upper limit in the invention. Such control of the surface treatment enables to maintain saturated electrostatic charge at a level of forming toner images of prescribed image quality. Further, a surface treatment is sufficiently performed and it becomes feasible to perform cleaning without giving rise to abrasion or flaws on the photoreceptor surface over a long period of time. Specifically, even when continuously performing printing in which it is difficult to take enough time for stirring a toner or when performing printing in an atmosphere of high temperature and high humidity in which effects of atmospheric moisture are not ignorable, charge-holding performance is ensured and print making of prescribed image quality is expected to be performed.

The iron content of a particulate titanate compound means a quantity of iron contained per mass of the titanate compound. It is assumed that iron is contained in the form an iron compound, such as typified by diiron trioxide [iron(III) oxide] or in the form of being incorporated in a crystal lattice.

As afore-described, the particulate titanate compound usable in the invention contains iron in an amount of not less than 100 ppm and not more than 1000 ppm. In the invention, an iron compound such as ferric chloride, ferric sulfide, or ferric oxide is preferably added in the process of preparing a particulate titanate compound and the iron content of the titanate compound can be controlled by adjusting the addition amount of the iron compound. It is supposed that such a titanate compound can stably retain iron in light of its structure.

The iron content of a particulate titanate compound can be quantitatively determined by using an inductively coupled plasma optical emission spectrometer (also denoted simply as ICP-OES).

A measurement method by ICP-OES is specifically described below.

Into a dried 200 ml conical beaker is placed 1 g of titanate compound particle. Further thereto is added 20 ml of sulfuric acid as a resolving agent, and the mixture is subjected to microwave resolution by using a sealed type microwave wet resolution apparatus (MILS-1200MEGA, made by MILESTONE Co.) and then cooled with water. Resolution by microwaves was conducted until unresolved substance disappears.

The thus resolved solution is transferred to a 100 ml messflask and distilled water is added thereto up to a marked line to make 100 ml to obtain a sample solution. The sample solution is measured in the ICP-OES at a Fe wavelength of 238.204 nm and the quantitative determination of Fe is carried out by using a calibration curve.

A calibration curve is made as follows. First, a titanate compound containing no iron (e.g., calcium titanate, strontium titanate, magnesium titanate) is microwave-resolved in the manner described above. The resolved solution is transferred into a 100 ml messflask and distilled water is added thereto up to a marked line to make 100 ml to obtain a sample solution. Therefrom, 25 ml is sampled to a 100 ml messflask, a Fe standard solution is added theretoto make 0 ppm, 250 ppm, 500 ppm, 750 ppm or 1000 ppm and distilled water is further added to make 100 ml as a sample to prepare a calibration curve. A calibration curve is prepared based on five points of the foregoing titanate compound.

There will be further described a titanate compound used in the invention. A titanate compound used in the invention preferably exhibits a BET specific surface area of not less than 5 $m^2/g$ and not more than 25 $m^2/g$. It is assumed that, when the BET specific surface area of a titanate compound falls within the foregoing range, it forms a field in which a charge is easily exchanged between a titanate compound and the surface of toner particles. Thus, it is also supposed that, when the BET specific surface area of a titanate compound falls within the foregoing range, the titanate compound added onto the toner particle surface acts like a pseudo carrier or acts like a condenser, whereby electrification performance of the toner particle is effectively controlled. Under an environment of low temperature and low humidity in which a toner is easily charged excessively, for example, an optimal contact area is secured, in which an electrostatic charge is easily transferred between a titanate particle and a toner particle, whereby an excessive charge is released via the iron atom. On the contrary, under an environment of high temperature and high humidity in which charge leakage easily occurs, the titanate acts like a pseudo carrier and supplies a charge capable of performing image formation at a prescribed level, whereby electrification property of the toner is maintained.

The BET specific surface area refers to a specific area of particles, calculated by a gas adsorption method. The calculation of the specific area of particles by a gas adsorption method is performed in such a manner that gaseous molecules such as nitrogen gas, of which adsorption-occupied area is known, are adsorbed onto particles and the specific surface area of the particle is calculated from its adsorption amount. The BET specific surface area can accurately calculate the amount of gas molecules adsorbed onto a solid surface (adsorption amount of monomolecular layer). The BET specific surface area can be calculated by a numerical expression, called BET equation, as below.

The equation of BET represents the relationship between the adsorption equilibrium pressure (P) in the adsorption equilibrium state at a given temperature and an adsorption amount (V), as described below.

$$P/[V(P_0-P)]=(1/VmC)+[(C-1)/VmC](P/P_0) \quad \text{Equation 1}$$

wherein $P_0$ is the saturated vapor pressure, Vm is a monomolecular layer adsorption amount, that is, an adsorption amount when gaseous molecules form a monomolecular layer on the solid surface, and C is a parameter (>0) regarding adsorption heat or the like. From the foregoing equation, the monomolecular layer adsorption amount (Vm) is calculated, which is multiplied by a sectional area occupied by a single gas molecule, whereby the surface area of particles is determined.

The BET specific surface area of a titanate compound used in the invention is a value by using an automatic specific area measurement apparatus (GEMINI 2360 (made by Shimazu•Micromeritics Co.) according to the measurement method described below.

First, 2 g of a titanate compound is placed into a straight sample cell and as a pre-treatment, the interior of the cell is replaced with nitrogen gas (purity: 99.999%). After replacement, a composite oxide is subjected to adsorption and desorption with nitrogen gas (purity: 99.999%) and the specific surface area is calculated by a multipoint method.

The titanate compound used in the invention preferably is titanate particles exhibiting a number average particle size not less than 50 nm and not more than 2000 nm, and more preferably not less than 50 nm and not more than 400 nm. It is supposed that when an average particle size falls within the foregoing range, enhanced electrification property of a toner and reduced scattering among toner particles are achieved, leading to enhanced stability. The reason is assumed to be that a number-based average particle size of a particulate titanate compound being not less than 50 nm can avoid strong sticking of the titanate compound onto the toner particle surface. It is further assumed that since the titanate compound is in the state of not being strongly stuck onto the toner particle surface, the titanate compound containing iron atoms in a prescribed amount acts in a balanced manner to maintain electrification performance, while contributing to enhanced flowability.

It is still further assumed that a number average particle size of not more than 2000 nm makes a titanate compound difficult to leave the toner surface, contributing to enhancement of electrification property of a toner. It is supposed that, in a print making environment of a relatively small number of printing sheets, for example, an unused toner is frequently stirred in a developing device and is often strongly stressed, but even in such an environment of being subjected to strong stress, it is difficult for the titanate compound to separate from the toner particle surface; accordingly, electrification performance of the toner is excellently maintained even in such a print making environment.

The number average particle size of a particulate titanate compound can be determined from, for example, an electronmicrograph. Specifically, it is possible to calculate it in the following procedure:

(1) Toner particles are photographed by a scanning electron microscope at a magnification of 30,000 fold and the obtained photographic image is introduced to a scanner. (2) Titanate compound particles existing on the toner particle surface are subjected to a binary treatment in an image processing analyzer (LUZEX AP, produced by Nireco Co.) to determine the horizontal Feret diameter of 100 particles and the average value of the horizontal Feret diameters is defined as an average particle size. Herein, when a titanate compound particle is sandwiched with two vertical lines, the distance between the two vertical lines is defined as the horizontal Feret diameter.

Besides the foregoing method of photographing toner particles and employing titanate particles attached to the toner particle surface, titanate compound particles are directly photographed by a scanning electron microscope and the average particle size can be determined from the obtained photographic image in a similar procedure.

A particulate titanate compound used in the invention preferably exhibits a standard deviation of particle size of not more than 250 nm. It is supposed that when the standard deviation of particle size of titanate compound particles fall within the foregoing range, the use of such titanate compound particles results in reduced scattering in its electrification-contributing performance and every titanate particle achieves electrification performance at the same level for a single toner particle, effectively contributing to attainment of uniform-charging of toner particles.

The standard deviation of particle size (also denoted as a SD value) represents a number-based particle size distribution of a particulate titanate compound and is determined in such a manner that a number-based 84% particle size (also denoted as D84) and a number-based 16% particle size (also denoted as D16) of the particulate titanate compound are measured and the difference thereof is divided by 2. Thus, the particle size standard deviation (SD value) is represented by the following expression:

Particle size standard deviation (SD value)={[number-based 84% particle size (or $D84$)]−[number-based 16% particle size (or $D16$)]}/2

The amount of a titanate compound added to a toner is preferably from 0.05 to 10.0% by mass of the entire toner, more preferably from 0.1 to 5.0% by mass, and still more preferably from 0.3 to 2.0% by mass. When a titanate compound is added in an amount falling within the foregoing range, stable electrification performance of a toner is assured and the added titanate compound does not leave the toner particle surface, so that there is no concern that the photoreceptor surface is damaged by any released titanate compound. There is also usable a titanate compound which has been surface-treated with silicone oil or the like. The use of such a surface-treated titanate compound can achieve enhanced electrification performance such as environmental stability of a toner, while inhibiting staining of a toner particle layer support of a carrier or developing roller.

Next, there will be described a toner relating to the invention. The toner relating to the invention externally incorporates a particulate titanate compound having a carbon amount of not less than 0.15% by mass and not more than 0.50% by mass. Toner particles constituting a parent body of the toner relating to the invention, that is, particles before an external additive is added can be produced by the methods known in the field of toner technologies, such as a dry process, for example, a grinding method; and a wet granulating process, for example, an emulsion polymerization coagulation method, a suspension polymerization method, a solution suspension method, a polyester molecule elongation method and the like. Of these methods, production by the emulsion polymerization coagulation method is preferred and a mini-emulsion polymerization coagulation method is specifically preferred in which resin particles formed through multi-stepped emulsion polymerization are coalesced (coagulation/fusion, that is, particles being coalesced and simultaneously being thermally fused to be allowed to coalesce.

Toner particles relating to the invention preferably exhibit a volume-based median diameter (D50v diameter) of not less than 2 μm and not more than 8 μm. When the volume-based median diameter falls within the foregoing range, minute dot images at a level of 1200 dpi (dpi: the number of dots per inch or 2.54 cm).

The volume-based median diameter falling within the foregoing range makes it possible to perform faithful reproduction of dot images forming a photographic images or the like, and forming a highly precise color photographic image at a level equivalent to or higher than a printed image. In the field of printing, specifically in the field of called on-demand printing in which printing order is received at a level of some hundreds sheets to some thousands of sheets, there becomes feasible rapid delivery of full-color, high image quality prints having a highly precise photographic image to a user feasible.

The volume-based median diameter (D50v diameter) of toner particles can be measured and calculated using Multisizer 3 (produced by Beckman Coulter Co.) connected to a data processing computer system in the procedure described below.

A toner in an amount of 0.02 g is treated with a 20 ml surfactant solution (in which a neutral detergent containing a surfactant component is diluted 10 times with pure water) and then subjected to ultrasonic dispersion for 1 min. to prepare a toner dispersion. The toner dispersion is introduced by a pipette into a beaker containing ISOTON II (produced by Beckman Coulter Co.), placed in a sample stand until reaching a measured concentration of 5-10% and the analyzer count is set to 2500 particles. The aperture diameter of Multisizer 3 is 50 μm.

Toner particles used in the invention preferably exhibit a coefficient of variation (also denoted simply as a CV value) of volume-based particle size distribution of not less than 2% and not more than 21%, and more preferably not less than 5% and not more than 15%. The coefficient of variation (CV value) of volume-based particle size distribution represents dispersion in the volume-based particle size distribution of toner particles and is defined by the following expression:

CV value=(standard deviation in volume-based particle size distribution)/[median diameter ($D50v$) in volume-based particle size distribution]

A smaller CV value represents a narrow particle size distribution and means that the particle sizes become close to uniform size. Thus, toner particles of relatively uniform particle size are obtained, making it feasible to perform precise reproduction of fine dot images or fine lines, as desired in digital image formation. Further, when printing a photographic image, the use of small toner particles of uniform size makes it possible to form an image of high quality at a level equivalent to or higher than an image level prepared by printing ink.

The toner particles used in the invention preferably exhibit an average circularity, as defined below, of 0.950 to 0.995, and more preferably 0.960 to 0.995.

Average circularity=(circumference length of circle obtained from circle equivalent diameter)/(circumference length of particle projection image)

The measurement method of the average circularity is not specifically limited. For example, the average circularity is determined in such a manner that toner particles are photographed by an electron microscope at a magnification of 500 fold, the circularities of 500 toner particles are measured from the obtained electronmicrographs by using an image analyzing apparatus, and the average circularity is calculated from the arithmetic average thereof.

When the average circularity of a toner used in the invention falls within the range of 0.950 to 0.995, the toner used for image formation is relatively uniform in shape and there is removed a concern of adverse effects on image quality, due to the shape of toner particles. Thus, a uniform shape of toner particles results in reduced scattering in melting or solidifying of toner particles at the time of fixing and adhesion of an external additive to toner particles becomes has become uniform and a working effect by external-additive particles becomes uniform. Further, resistance to stress applied at the time of image formation is also uniformalized. Accordingly, it is expected that toner images of excellent image quality, having no scattering in color or density are obtained by these effects.

The toner relating to the invention preferably exhibits a softening point temperature (Tsp) of not more than 121° C. and more preferably not less than 70° C. and not more than 100° C. A colorant used for the toner relating to the invention exhibits stable property without causing any change in spectrum even when subjected to thermal influence, but a softening point falling within the foregoing range results in reduced influence of heating which is applied to a toner in fixing.

A softening point falling within the foregoing range makes it possible to perform fixing of a toner image at a lower temperature than the prior art, rendering it feasible to perform image formation which realizes reduction in power consumption and is friendly to the environment. Further, it is preferable for achievement of stable fixing performance in the field of POD, as one of the print markets capable of employing the present invention.

The softening point of a toner can be controlled by the following methods, singly or in combination.

(1) The kind or composition ratio of monomers used for resin formation is controlled.

(2) The molecular weight of a resin is controlled by the kind of a chain transfer agent or its addition amount.

(3) The kind or addition amount of wax or the like is controlled.

Specifically, the softening point of a toner is measured in the manner that using Flow Tester CFT-500 (produced by Shimazu Seisakusho Co., Ltd.), a 10 mm high circular column is formed and extruded through a nozzle of a 1 mm diameter and a 1 mm length, while applying pressure at $1.96\times10^6$ Pa by a plunger with heating at a temperature-increasing rate of 6°/min, whereby a curve (softening flow curve) between falling speed of the plunger of the flow tester and temperature is prepared and the initially flowing-out temperature is defined as the melt-initiation temperature and a temperature corresponding to a falling amount of 5 mm is defined as the softening point temperature.

In the following, there is described the production method of a toner used in the invention.

The toner particles used in the invention comprise toner parent particles and further thereon a particulate titanate compound which has externally been added onto the parent toner particle surface. The toner parent particles constituting the toner particles used in the invention (which are parent particles before having been subjected to an external treatment) are not specifically restricted and can be produced by conventional toner production methods. There are cited, for example, a toner production method by a grinding process of producing a toner via kneading, grinding and classifying steps and a toner production method by a polymerization process of polymerizing a polymerizable monomer with controlling shape or size to form particles. Examples of such a toner production method by a polymerization process include an emulsion polymerization method, a suspension polymerization method and a polyester stretching method. The toner production method by a polymerization process can control shape or size in the step of particle formation.

The toner production method by a grinding process is performed preferably with maintaining a kneaded material at a temperature of not more than 130° C. It is supposed that, when a temperature applied to the kneaded material exceeds 130° C., the action of heating applied the kneaded material results in variation in the aggregation state of a colorant in the kneaded material, making it difficult to maintain a uniform aggregation state. Accordingly, there is concern such that the thus prepared toner varies in color, leading to color contamination.

Next, there will be described toner constituents such as a resin, wax, a colorant and the like, with reference to specific examples thereof.

A resin forming the toner used in the invention is not specifically restricted and is typified by a polymer formed by polymerization of a polymerizable monomer, called vinyl monomer. A polymer constituting a resin usable in the invention is constituted of a polymer obtained by polymerization of at least one polymerizable monomer and is a polymer which is prepared by combinations of one or plural kinds of vinyl monomers.

Specific examples of a vinyl monomer are shown below.

(1) Styrene and Styrene Derivative:

styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene;

(2) Methacryl Acid Ester Derivative:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate;

(3) Acrylic Acid Ester Derivative:

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate;

(4) Olefins:

ethylene, propylene, isopbutylene;

(5) Vinyl Esters:

vinyl propionate, vinyl acetate, vinyl benzoate;

(6) Vinyl Ethers:

vinyl methyl ether, vinyl ethyl ether;

(7) Vinyl Ketones:

vinyl methyl ketone, vinyl ethyl ketone, vinyl hexyl ketone;

(8) N-vinyl Compounds:

N-vinylcarbazole, N-vinylindole, N-vinylpyrrolidone;

(9) Others:

vinyl compounds such as vinylnaphthalene, vinylpyridine; acrylic acid or methacrylic acid derivatives such as acrylonitrile, methacrylonitrile and acrylamide.

Polymerizable vinyl monomers forming a resin usable in the toner relating to the present invention can also employ one containing an ionic dissociative group such as a carboxyl group, a sulfonic acid group or a phosphoric acid group.

Examples of such one containing a carboxyl group include acrylic acid, methacrylic acid, maleic acid, itaconic acid, cinnamic acid, fumaric acid, maleic acid monoalkyl ester and itaconic acid monoalkyl ester. Examples of such one containing a sulfonic acid group include styrene sulfonic acid, allylsulfosuccinic acid, and 2-acrylamido-2-methylpropane sulfonic acid. Examples of such one containing a phosphoric acid group include acidophosphooxyethyl methacrylate.

A resin of a crosslinking structure can also prepare by using poly-functional vinyl compounds. Examples thereof are as below:

ethylene glycol dimethacrylate, ethylene glycol diacrylate, diethylene glycol dimethacrylate, diethylene glycol diacrylate, triethylene glycol dimethacrylate, triethylene glycol diacrylate, neopentylene glycol dimethacrylate, and neopentylene glycol diacrylate.

Colorants usable in the toner relating to the invention include those known in the art and specific examples thereof are as follows:

Examples of colorants used for black toners include carbon black such as Furnace Black, Channel Black, Acetylene Black, Thermal Black and Lamp Black.

Colorants used for color toners employ pigments or dyes composed of organic compounds, as shown below.

Specific examples of magenta and red colorants include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 60, C.I. Pigment Red 63, C.I. Pigment Red 64, C.I. Pigment Red 68, C.I. Pigment Red 81, C.I. Pigment Red 83, C.I. Pigment Red 87, C.I. Pigment Red 88, C.I. Pigment Red 89, C.I. Pigment Red 90, C.I. Pigment Red 112, C.I. Pigment Red 114, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 163, C.I. Pigment Red 166, C.I. Pigment Red 170, C.I. Pigment Red 177, C.I. Pigment Red 178, C.I. Pigment Red 184, C.I. Pigment Red 202, C.I. Pigment Red 206, C.I. Pigment Red 207, C.I. Pigment Red 209, C.I. Pigment Red 222, C.I. Pigment Red 238 and C.I. Pigment Red 269.

Specific examples of orange or yellow colorants include C.I. Pigment Orange 31, C.I. Pigment Orange 43, C.I. Pigment Yellow 12, C.I. Pigment Yellow 14, C.I. Pigment Yellow 15, C.I. Pigment Yellow 17, C.I. Pigment Yellow 74, C.I. Pigment Yellow 83, C.I. Pigment Yellow 93, C.I. Pigment Yellow 94, C.I., Pigment Yellow 138, C.I. Pigment Yellow 155, C.I. Pigment Yellow 162, C.I. Pigment Yellow 180 and C.I. Pigment Yellow 185.

Specific examples of green or cyan colorants include C.I. Pigment Blue 2, C.I. Pigment Blue 3, C.I. Pigment Blue 15, C.I. Pigment Blue 15:2, C.I. Pigment Blue 15:3, C.I. Pigment Blue 15:4, C.I. Pigment Blue 16, C.I. Pigment Blue 17, C.I. Pigment Blue 60, C.I. Pigment Blue 62, C.I. Pigment Blue 66 and C.I. Pigment Green 7.

Specific examples of dyes include C.I. Solvent Red 1, C.I. Solvent Red 49, C.I. Solvent Red 52, C.I. Solvent Red 58, C.I. Solvent Red 63, C.I. Solvent Red 111, C.I. Solvent Red 122, C.I. Solvent Yellow 2, C.I. Solvent Yellow 6, C.1. Solvent Yellow 14, C.I. Solvent Yellow 15, C.I. Solvent Yellow 16, C.1. Solvent Yellow 19, C.I. Solvent Yellow 21, C.I. Solvent Yellow 33, C.I. Solvent Yellow 44, C.I. Solvent Yellow 56, C.I. Solvent Yellow 61, C.I. Solvent Yellow 77, C.I. Solvent Yellow 79, C.I. Solvent Yellow 80, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93 and C.I. Solvent Blue 95.

The foregoing colorants may be used singly or in combination. The colorant content is preferably from 1% to 30% by mass, and more preferably 2% to 20% by mass of the whole of a toner.

Waxes usable in the toner of the invention are shown below. Examples thereof include: (1) polyolefin wax such as polyethylene wax and polypropylene wax; (2) long chain hydrocarbon wax such as paraffin wax and sasol wax; (3) dialkylketone type wax such as distearylketone; (4) ester type wax such as carnauba wax, montan wax, trimethylolpropane tribehenate, pentaerythritol tetramyristate, pentaerythritol tetrabehenate, pentaerythritol diacetate dibehenate, glycerin tribehenate, 1,18-octadecanediol distearate, trimellitic acid tristearate, and distearyl meleate; and (5) amide type wax such as ethylenediamine dibehenylamide and trimellitic acid tristearylamide.

The melting point of a wax usable in the invention is preferably 40 to 125° C., more preferably 50 to 120° C., and still more preferably 60 to 90° C. A melting point falling within the foregoing range ensures heat stability of toners and can achieve stable toner image formation without causing cold offsetting even when fixed at a relatively low temperature. The wax content of the toner is preferably in the range of 1% to 30% by mass, and more preferably 5% to 20%.

The toner relating to the invention is usable as a single-component developer or a two-component developer. When the toner relating to the invention which is mixed with a carrier of magnetic particles is used as a two-component developer, stable electrification characteristic can be maintained by the action of the afore-described titanate compound added as an external additive. In image formation of a two-component development system, there was observed a tendency making it difficult to perform uniform electrification of the toner when performing image formation at relatively low toner consumption, for example, print making at a low printing volume. It was supposed that, in an environment of a low toner consumption, identical toner particles stayed at the charged point of a carrier for a long time and interfered with electrification of newly supplied toner particles. In the two-component developer using the toner of the invention, uniform toner electrification is performed even in such an image forming environment. It is supposed that the particulate titanate compound incorporated onto the toner particle surface acts as a low resistant component, making it easy to transfer a charge between the toner particles and a carrier, whereby stationary toner particles become easy to be released from the carrier surface.

When the toner relating to the invention is used as a two-component developer, materials known in the art are usable as a carrier and include, for example, a metal such as iron, ferrite, magnetite, or the like; alloys of these metals and aluminum or lead FIG. 1 shows a schematic view of a color image forming apparatus which is usable when using the toner relating to the invention as a two component developer.

In FIG. 1, 1Y, 1M, 1C and 1K are each a photoreceptor; 4Y, 4M, 4C and 4K are each a developing device; 5Y, 5M, 5C and 5K are each a primary transfer roll as a primary transfer means; 5A is a secondary transfer roll as a secondary transfer means; 6Y, 6M, 6C and 6K are each a cleaning device; 7 is an intermediate transfer unit, 24 is a heat roll type fixing device, and 70 is an intermediate transfer body unit.

This image forming apparatus is called a tandem color image forming apparatus, which is, as a main constitution, comprised of plural image forming sections 10Y, 10M, 10C and 10Bk; an intermediate transfer material unit 7 of an endless belt form, a paper feeding and conveying means 21 to convey a recording member P and a heat-roll type fixing device 24 as a fixing means. Original image reading device SC is disposed in the upper section of an image forming apparatus body A.

As one of different color toner images of the respective photoreceptors, image forming section 10Y to form a yellow image comprises a drum-form photoreceptor 1Y as the first photoreceptor; an electrostatic-charging means 2Y, an exposure means 3Y, a developing means 4Y, a primary transfer roller 5Y as a primary transfer means; and a cleaning means 6Y, which are disposed around the photoreceptor 1Y.

As another one of different color toner images of the respective photoreceptors, image forming section 10M to form a magenta image comprises a drum-form photoreceptor 1M as the first photoreceptor; an electrostatic-charging means 2M, an exposure means 3M, a developing means 4M, a primary transfer roller 5M as a primary transfer means; and a cleaning means 6M, which are disposed around the photoreceptor 1M.

Further, as one of different color toner images of the respective photoreceptors, image forming section 10C to form a cyan image comprises a drum-form photoreceptor 1C as the first photoreceptor, an electrostatic-charging means 2C, an exposure means 3C, a developing means 4C, a primary transfer roller 5C as a primary transfer means; and a cleaning means 6C, which are disposed around the photoreceptor 1C.

Furthermore, as one of different color toner images of the respective photoreceptors, image forming section 10K to form a cyan image comprises a drum-form photoreceptor 1K as the first photoreceptor; an electrostatic-charging means 2K, an exposure means 3K, a developing means 4K, a primary transfer roller 5K as a primary transfer means; and a cleaning means 6K, which are disposed around the photoreceptor 1K.

Intermediate transfer unit 7 of an endless belt form is turned by plural rollers and has intermediate transfer material 70 as the second image carrier of an endless belt form, while being pivotably supported.

The individual color images formed in image forming sections 10Y, 10M, 10C and 10Bk are successively transferred onto the moving intermediate transfer material (70) of an endless belt form by primary transfer rollers 5Y, 5M, 5C and 5Bk, respectively, to form a composite color image. Recording member P of paper or the like, as a final transfer material housed in a paper feed cassette 20, is fed by paper feed and a conveyance means 21 and conveyed to a secondary transfer roller 5*b* through plural intermediate rollers 22A, 22B, 22C and 22D and a resist roller 23, and color images are secondarily transferred together on the recording member P. The color image-transferred recording member (P) is fixed by a heat-roll type fixing device 24, nipped by a paper discharge roller 25 and put onto a paper discharge tray 26 outside a machine.

After a color image is transferred onto the recording member P by a secondary transfer roller 5A as a secondary transfer means, an intermediate transfer material 70 of an endless belt form which separated the recording material P removes any residual toner by cleaning means 6A.

During the image forming process, the primary transfer roller 5K is always in contact with the photoreceptor 1K. Other primary transfer rollers 5Y, 5M and 5C are each in contact with the respectively corresponding photoreceptors 1Y, 1M and 1C only when forming a color image.

The secondary transfer roller 5*b* is in contact with the intermediate transfer material 70 of an endless belt form only when the recording member P passes through to perform secondary transfer.

Image forming sections 10Y, 10M, 10C and 10K are aligned vertically. The endless belt intermediate transfer material unit 7 is disposed on the left side of photoreceptors 1Y, 1M, 1C and 1Bk, as indicated in FIG. 2. The intermediate transfer material unit 7 comprises the endless belt intermediate transfer material 70 which can be turned via rollers 71, 72, 73, 74, and 76 primary transfer rollers 5Y, 5M, 5C and 5Bk and cleaning means 6A.

Thus, toner images are formed on the photoreceptors 1Y, 1M, 1C and 1K via charging, exposure and development, toner images of the respective colors are superimposed on the endless belt intermediate transfer material 70, transferred together to the recording member P and fixed by applying pressure with heating in the fixing device 24. After having transferred the toner image onto the recording member P, the photoreceptor 1Y, 1M, 1C and 1K are each cleaned in a cleaning device 6A to remove a remained toner and enter the next cycle of charging, exposure, and development to perform image formation.

EXAMPLES

The present invention will be described with reference to examples but the invention is by no means limited to these.

Preparation of Titanate Compound (1) Preparation of Titanate Compound 1:

A metatitanic acid dispersion was adjusted to a pH of 9.0 with an aqueous 4.0 mole/l sodium hydroxide solution and subjected to a desulphurization treatment and then was neutralized by adjusting the pH to 5.5 with adding an aqueous 6.0 mole/l hydrochloric acid solution. The metatitanic acid dispersion was filtered off and washed with water to obtain a cake of metatitanic acid. Further, water was added to the metatitanic acid cake to prepare a dispersion corresponding to an equivalent quantity of $TiO_2$ of 1.25 mol/l and an pH was adjusted to 1.2 with an aqueous 6.0 mol/l hydrochloric acid solution. Then, the dispersion was adjusted to a temperature of 35° C. and stirred for 1 hour. to deflocculate the metatitanic acid dispersion.

From the thus deflocculated metatitanic acid dispersion was taken out metatitanic acid in an equivalent quantity of $TiO_2$ of 0.156 mol/l and placed into a reaction vessel. Subsequently, an aqueous calcium carbonate ($CaCO_3$) solution and aqueous ferric chloride solution were added to the reaction vessel. Therein, the reaction system was adjusted so that the concentration of titanium oxide was 0.156 mole/l, calcium carbonate ($CaCO_3$) was added so that the molar ratio of calcium carbonate to titanium oxide was 1.15 (i.e., $CaCO_3/TiO_2$=1.15/1.00), and ferric chloride was added so that the molar ratio of ferric chloride to titanium oxide was 0.006 (i.e., $FeCl_3/TiO_2$=0.009/1.000).

To the reaction vessel was supplied nitrogen gas and after allowed to stand for 20 min., the interior of the reaction vessel became a nitrogen gas atmosphere and a mixed solution of metatitanic acid, calcium carbonate and ferric chloride was heated to 90° C. Subsequently, an aqueous sodium hydroxide solution was added over 24 hours until it reached pH 8.0 and was further stirred at 90° C. over 1 hour to complete the reaction.

After completion of the reaction, the interior of the reaction vessel was cooled to 40° C. and the supernatant solution was decanted under a nitrogen atmosphere. Then, 2500 parts by mass of pure water was added to the reaction vessel and decantation was repeated two times. After completion of decantation, the reaction system was filtered off through a Nutsche funnel to form a cake. The thus formed cake was heated at 110° C. and dried in atmosphere for 8 hours.

The thus dried calcium titanate was placed into an alumina crucible and calcined at 930° C. with being dehydrated. The thus calcined calcium titanate was placed into water and subjected to a wet grinding treatment by using a sand grinder to obtain a dispersion. Further thereto, an aqueous 6.0 mol/l hydrochloric acid solution was added to adjust the pH to 2.0 to remove excess calcium carbonate.

After removal of excess calcium carbonate, the calcium titanate was subjected to a wet surface treatment with a silicone oil emulsion (dimethyl polysiloxane based emulsion, SM7036EX, manufactured by Toray Dow Corning Co., Ltd.). A surface treatment was conducted by adding 0.9 parts by mass of the silicone oil emulsion to 100 parts by mass of calcium titanate solids and stirring for 30 min.

After completing the wet surface treatment, an aqueous 4.0 mol/l sodium hydroxide solution was added thereto to adjust the pH to 6.5 for neutralization. Thereafter, filtration and washing were conducted and drying was conducted at 150° C. Then, a grinding treatment was conducted over 60 min. by using a mechanical grinding apparatus to prepare a titanate compound 1.

The carbon amount of the thus prepared titanate compound 1, which was measured by using carbon analytical instrument, IR-212 (made by LECO Co., Ltd.), as described earlier, was 0.09% by mass. The iron content, which was measured by ICP-OES, was 102 ppm. The volume-based particle size, particle size standard deviation (SD value) and BET specific surface area, which were each measured in accordance with the methods described earlier, were 207 nm, 111 nm and 13.2 $m^2/g$, respectively.

(2) Preparation of Titanate Compounds 2-7:

Titanate compounds 2-6 were each prepared in the same manner as the titanate compound 1, except that the addition amount of the silicone oil emulsion, as described above was varied to 0, 0.5. 1.6, 2.6, 2.8 or 2.8 parts by mass, respectively, and the treatment time was changed to 60 min. Titanate compound 7 was also prepared in the same manner as the titanate compound 1, except that the addition amount of the silicone oil emulsion was varied to 2.8 parts by mass and the treatment time was varied to 80 min.

(3) Preparation of Titanate Compounds 8-10:

Titanate compounds 8-10 were each prepared in the same manner as the titanate compound 1, except that to perform the reaction, only an aqueous calcium carbonate ($CaCO_3$) solution was added to the reaction vessel in which deflocculated metatitanic acid was placed, and the surface treatment was conducted similarly to the titanate compounds 3-5.

(4) Preparation of Titanate Compounds 11-13:

Titanate compounds 11-13 were each prepared in the same manner as the titanate compound 1, except that the addition amount of an aqueous ferric chloride solution to the reaction vessel, in which deflocculated metatitanic acid was placed, was varied to 0.006 mol, 0.075 mol or 0.086 mol, respectively; and the surface treatment was conducted with 1.6 parts by mass of silicone oil emulsion over 60 min.

(5) Preparation of Titanate Compounds 14 and 15:

Titanate compounds 14 and 15 were each prepared in the same manner as the titanate compound 1, except that the aqueous calcium carbonate ($CaCO_3$) solution added to the reaction vessel in which metatitanic acid was placed, was replaced by an aqueous magnesium carbonate solution or an aqueous strontium carbonate solution; and the surface treatment was conducted by using 1.6 parts by mass of the silicone oil emulsion over 60 min.

The thus prepared titanate compounds 1-15 are shown in Table 1, with respect to addition amount of silicone oil emulsion and its treatment time, carbon amount, iron content, number average particle size, particle size standard deviation (SD value) and BET specific surface area.

TABLE 1

| | | Surface Treatment | | | | | Physical Property | | |
|---|---|---|---|---|---|---|---|---|---|
| | | Addition | | Carbon | Iron | | Number | | |
| Titanate Compound No. | Metal Atom | Amount (parts by mass) | Treatment Time (min) | Amount (% by mass) | $FeCl_3$ (mole) | Fe Content (ppm) | Average Particle Size (nm) | Particle Size Standard Deviation (nm) | BET Specific Surface Area ($m^2/g$) |
| 1 | calcium | 0.9 | 30 | 0.09 | 0.009 | 102 | 207 | 111 | 13.2 |
| 2 | calcium | 0 | — | 0 | 0.009 | 102 | 205 | 110 | 14.0 |
| 3 | calcium | 0.5 | 60 | 0.15 | 0.009 | 102 | 204 | 108 | 12.8 |
| 4 | calcium | 1.6 | 60 | 0.31 | 0.009 | 102 | 205 | 111 | 11.5 |
| 5 | calcium | 2.6 | 60 | 0.49 | 0.009 | 102 | 206 | 112 | 10.5 |
| 6 | calcium | 2.8 | 60 | 0.53 | 0.009 | 102 | 207 | 110 | 10.1 |
| 7 | calcium | 2.8 | 80 | 0.61 | 0.009 | 102 | 208 | 111 | 10.2 |
| 8 | calcium | 0.5 | 60 | 0.15 | — | — | 204 | 108 | 12.8 |
| 9 | calcium | 1.6 | 60 | 0.31 | — | — | 205 | 111 | 11.5 |
| 10 | calcium | 2.6 | 60 | 0.49 | — | — | 206 | 112 | 10.5 |
| 11 | calcium | 1.6 | 60 | 0.30 | 0.006 | 80 | 205 | 111 | 11.5 |
| 12 | calcium | 1.6 | 60 | 0.32 | 0.075 | 1010 | 204 | 112 | 11.4 |
| 13 | calcium | 1.6 | 60 | 0.32 | 0.086 | 1102 | 206 | 110 | 11.5 |
| 14 | magnesium | 1.6 | 60 | 0.32 | 0.009 | 103 | 205 | 110 | 11.3 |
| 15 | strontium | 1.6 | 60 | 0.32 | 0.009 | 101 | 205 | 111 | 11.2 |

Preparation of Toner Parent Particle 1

(1) Preparation of Resin Particle 1H:

In a reaction vessel fitted with a stirrer, a temperature sensor, a condenser tube, and a nitrogen-introducing device was dissolved 7.08 parts by mass of an anionic surfactant (sodium laurylsulfate) in 3010 parts by mass of deionized water to prepare a surfactant solution (aqueous medium). While stirring the surfactant solution at a rate of 230 rpm under a stream of nitrogen, the temperature within the reaction vessel was raised to 80° C.

To the surfactant solution was added a polymerization initiator solution in which 9.2 parts by mass of potassium persulfate (KPS) as a polymerization initiator was dissolved in 200 parts by mass of deionized water, and the temperature within the reaction vessel was controlled to 75° C. Thereto, a mixed solution 1A composed of compounds, as shown below, was dropwise added over 1 hour.

| | |
|---|---|
| Styrene | 69.4 parts by mass |
| n-Butyl acrylate | 28.3 parts by mass |
| Methacrylic acid | 2.3 parts by mass |

Further, stirring was continued at a temperature of 75° C. to perform polymerization to prepare a resin particle dispersion 1H.

(2) Preparation of Resin Particle 1HM:

The following compounds were placed into a flask fitted with a stirrer.

| | |
|---|---|
| Styrene | 97.1 parts by mass |
| n-Butyl acrylate | 39.7 parts by mass |
| Methacrylic acid | 3.22 parts by mass |
| n-Octyl 3-mercaptopropionate | 5.6 parts by mass |

Further thereto, the following compound,

Pentaerythritol tetrabehenate at 98.0 parts by mass was added and dissolved at 90° C. to prepare a mixed solution B composed of the foregoing compounds.

Further, in a reaction vessel fitted with a stirrer, a temperature sensor, a condenser tube and a nitrogen-introducing device was dissolved 1.6 parts by mass of sodium laurylsulfate in 2700 parts by mass of deionized water and was heated to 98° C. To this surfactant solution was added the resin particle dispersion 1H in a solid content of 28 parts by mass and then, the mixed solution B was added thereto to prepare a mixture. Further, the thus prepared mixture was stirred over 8 hours by using a mechanical dispersing device provided with a circulation path (CLEARMIX, produced by M Tech Co., Ltd.) to prepare a dispersion (emulsion).

Subsequently, to the prepared dispersion (emulsion) were added an initiator solution of 5.1 parts by mass of potassium persulfate (KPS) dissolved in 240 parts by mass of deionized water and 750 parts by mass of deionized water, and stirred at 98° C. for 12 hours to perform polymerization. There was thus prepared a dispersion of a resin particle 1HM having a composite structure in which the surface of the resin particle 1H was covered with a resin.

(3) Preparation of Resin Particle 1HML:

To a dispersion of the foregoing resin particle 1HM was added an initiator solution of 7.4 parts by mass of potassium persulfate (KPS) dissolved in 200 parts by mass of deionized water and the temperature was controlled to 80° C. Then, a mixed solution 1C composed of the compounds below was dropwise added over 1 hour.

| | |
|---|---|
| Styrene | 277 parts by mass |
| n-Butyl acrylate | 113 parts by mass |
| Methacrylic acid | 9.21 parts by mass |
| n-Octyl 3-mercaptopropionate | 10.4 parts by mass |

After completing addition, the reaction mixture was stirred at the foregoing temperature over 2 hours to perform polymerization and then, the reaction system was cooled to 28° C. to prepare a dispersion of resin particle 1HML having a composite structure of the surface of the resin particle 1 HM being covered with a resin.

(4) Preparation of Colorant Dispersion 1Bk

To 1600 parts by mass of deionized water was added 90 parts by mass of an anionic surfactant of sodium laurylsulfate with stirring to prepare a surfactant solution. While stirring the prepared surfactant solution, carbon black, as described below, was gradually added thereto:

| | |
|---|---|
| Regal 330R (product by Cabot Co.) | 400 parts by mass |

After addition, the mixture was stirred by using a mechanical dispersing device provided with a circulation path (CLEARMIX, produced by M Tech Co., Ltd.) to disperse the carbon black until the particle size of the carbon black reached 200 nm.

(5) Preparation of Toner Parent Particle 1

Into a reaction vessel fitted with a stirrer, a temperature sensor, a condenser tube, and a nitrogen-introducing device were placed compounds described below and the temperature within the reaction vessel was adjusted 30° C., and the pH was adjusted to 10.6 with an aqueous 5 mol/l sodium hydroxide solution.

| | |
|---|---|
| Resin particle dispersion 1HML | 200 parts by mass |
| Deionized water | 3000 parts by mass |
| Colorant dispersion 1Bk | 71 parts by mass (solids) |

Thereafter, an aqueous solution of 52.6 parts by mass of magnesium chloride hexahydrate dissolved in 70 parts by mass of deionized water, was added at 30° C. over 10 min. with stirring and then, the reaction system was allowed to stand for 3 min.

Then, the temperature of the reaction system was raised to 75° C. over 60 min. and coagulation of particles was initiated. Such coagulation was continued, while measuring the size of coagulated particles by Multisizer 3 (produced by Beckmann Coulter Co.).

When the volume-based median diameter of coagulated particles reached 6.5, an aqueous solution of 115 parts by mass of sodium chloride dissolved in 700 parts by mass was added thereto to stop the growth of particles. Further, ripening was carried out at 90° C. for 6 hours with stirring to continue fusion of particles. Thereafter, the reaction system was cooled to 30° C. and the pH was adjusted to 2.0 by adding hydrochloric acid and stirring was stopped.

Toner parent particles which were thus prepared through coagulation and fusion were subjected to solid-liquid separation, were repeatedly washed with deionized water and dried by hot air at 40° C. to prepare a toner parent particle 1. The acid value of the thus prepared toner parent particle 1 was measured by the method defined in JIS-0070-1992 and was proved to be 15.

Preparation of Toners 1-15

(1) Preparation of Toner 1:

To 100 parts by mass of the foregoing toner parent particle 1 were added external additives described below.

| | |
|---|---|
| Titanate compound 1 | 2.0 parts by mass |
| #380 Silica (HMD-treated material) | 1.0 part by mass |
| #90 Silica (HMD-treated material) | 1.0 part by mass |

An external-additive treatment was conducted at 30° C. for 60 min. by using a Henschel mixer at a circumferential rate of 35 m/sec and coarse particles were removed by using a sieve of a 45 μm aperture, whereby Toner 1 was prepared.

(2) Preparation of Toners 2-15:

Toners 2-15 were prepared in the same manner as the toner 1, except that the titanate compound 1 added to the toner parent particle 1 was varied to titanate compounds 2-15, as shown in Table 1.

Evaluation Experiment

The thus prepared toners 1-15 were each allowed to stand 24 hours under a low temperature and low humidity (10° C., 15% RH) or a high temperature and high humidity (30° C., 85% RH) to obtain aged toners. Using each of the thus aged toners, continuous printing was conducted to evaluate the toners.

Charging each of the aged toners into a commercially available printer, bizhub PRO 1050e and a BW 5% chart, continuous-printing of 500,000 sheets was conducted and after completion of continuous-printing, evaluation was made with respect to image quality.

Herein, toners 3-5 and 8-15 which fall within the scope of the invention are denoted as Examples 1-11, and toners 1, 2, 6 and 7 which do not fall within the scope of the invention are denoted Comparative Examples 1-4.

Evaluation was made based on the following criteria:

(1) Photoreceptor Abrasion:

A: Abrasion loss was not more than 3 μm,

B: Abrasion loss was more than 3 μm, (2) Filming:

A: Neither filming nor unevenness of image was visually observed on the photoreceptor surface, B: Filming and unevenness of image density were visually observed on the photoreceptor surface, (3) Image Noise:

A: No noise was observed in solid images and halftone images,

B: Marked noise was observed in solid images and halftone images.

TABLE 2

| | Titanate Compound | | Low temperature and Low Humidity (10° C., 15% RH) | | | High temperature and High Humidity (30° C., 80% RH) | | |
|---|---|---|---|---|---|---|---|---|
| Example No. | No. | Carbon Amount (mass %) | Abrasion | Filming | Image Noise | Abrasion | Filming | Image Noise |
| 1 | 3 | 0.15 | A | A | A | A | A | A |
| 2 | 4 | 0.31 | A | A | A | A | A | A |
| 3 | 5 | 0.49 | A | A | A | A | A | A |
| 4 | 8 | 0.15 | A | A | A | A | A | A |
| 5 | 9 | 0.31 | A | A | A | A | A | A |
| 6 | 10 | 0.49 | A | A | A | A | A | A |
| 7 | 11 | 0.30 | A | A | A | A | A | A |
| 8 | 12 | 0.32 | A | A | A | A | A | A |
| 9 | 13 | 0.32 | A | A | A | A | A | A |
| 10 | 14 | 0.32 | A | A | A | A | A | A |
| 11 | 15 | 0.32 | A | A | A | A | A | A |
| Comp. 1 | 1 | 0.09 | B | B | A | B | B | A |
| Comp. 2 | 2 | 0 | B | B | B | B | B | B |
| Comp. 3 | 6 | 0.53 | A | B | B | A | A | A |
| Comp. 4 | 7 | 0.61 | A | B | B | A | B | B |

As is apparent from Table 2, it was proved that in Examples 1-11 using toners according to the invention, the abrasion loss of a photoreceptor was not more than 3 μm and neither filming nor image noise was observed both under an atmosphere of low temperature and low humidity, and under an atmosphere of high temperature and high humidity. On the contrary, in Comparative Examples 1-4 using toners which do not satisfy the requirement of the invention were inferior to Examples 1-11.

What is claimed is:

1. A toner comprising toner particles, wherein a surface-treated titanate compound is contained on the surface of parent toner particles comprising a resin and a colorant, and the titanate compound having a carbon amount of not less than 0.15% by mass and not more than 0.50% by mass, and the titanate compound contains iron in an amount of 100 ppm to 1000 ppm.

2. The toner of claim 1, wherein the titanate compound is one having been surface-treated with a silicone oil.

3. The toner, as described in claim 2, wherein the silicone oil comprises a dimethyl polysiloxane.

4. The toner of claim 1, wherein the titanate compound is in a particle form.

5. The toner of claim 1, wherein the titanate compound is a metatitanate represented by the formula (I):

$$M^{I}_{2}TiO_3 \text{ or } M^{II}TiO_3 \qquad \text{Formula (I)}$$

wherein $M^{I}$ represents a univalent metal and $M^{II}$ represents a bivalent metal.

6. The toner of claim 1, wherein the titanate Compound, is calcium titanate or magnesium, titanate.

7. The toner of claim 1, wherein the titanate compound exhibits a BET specific surface area of not less than is 5 $m^2/g$ and not more than 25 $m^2/g$.

8. The toner of claim 1, wherein the titanate compound exhibits a number-based average particle size of not less than 50 nm and not more than 2000 nm and a standard deviation of particle size of not more than 250 nm.

* * * * *